US005211153A

United States Patent [19]

Yonekawa et al.

[11] Patent Number: 5,211,153

[45] Date of Patent: May 18, 1993

[54] TWO-CYCLE INTERNAL COMBUSTION GASOLINE ENGINE CYLINDER

[75] Inventors: Minoru Yonekawa, Hachioji; Yoshiaki Nagao, Tokyo; Yasuharu Sato, Fussa; Isao Masuda, Tachikawa; Tomohiro Ohtani, Musashino, all of Japan

[73] Assignee: Kioritz Corporation, Tokyo, Japan

[21] Appl. No.: 828,759

[22] Filed: Jan. 31, 1992

[30] Foreign Application Priority Data

Feb. 1, 1991 [JP] Japan ..... 3-3183[U]

[51] Int. Cl.[5] ..... B22D 19/08

[52] U.S. Cl. ..... 123/668; 123/193.3

[58] Field of Search ..... 123/668, 657, 193.3

[56] References Cited

U.S. PATENT DOCUMENTS

| | | | |
|---|---|---|---|
| 2,412,698 | 12/1946 | van der Horst . | |
| 3,797,101 | 3/1974 | Bauer | 29/527.3 |
| 3,891,515 | 6/1975 | Paulson et al. | 204/275 |
| 4,065,365 | 12/1977 | Ibarguengoitia | 204/25 |
| 4,447,275 | 5/1984 | Hiraoka et al. | 123/41.72 |
| 4,523,554 | 6/1985 | Ryu | 123/193 C |
| 4,568,393 | 2/1986 | Kane et al. | 148/6.35 |
| 4,873,952 | 10/1989 | Narita et al. | 123/668 |
| 4,941,439 | 7/1990 | Wicen | 123/669 |
| 4,974,498 | 12/1990 | Lemelson | 123/193.6 |
| 5,000,133 | 3/1991 | Kawamura | 123/668 |
| 5,097,807 | 3/1992 | Oikawa et al. | 123/668 |

*Primary Examiner*—David A. Okonsky
*Attorney, Agent, or Firm*—Browdy and Neimark

[57] ABSTRACT

The present invention relates to a two-cycle internal combustion gasoline engine cylinder. The two-cycle engine cylinder according to this invention is characterized in that a smooth hard chromium plated layer is formed on a combustion chamber top inner surface of the cylinder.

3 Claims, 1 Drawing Sheet

TWO-CYCLE INTERNAL COMBUSTION GASOLINE ENGINE CYLINDER

BACKGROUND OF THE INVENTION

This invention relates to a two-cycle internal combustion gasoline engine cylinder.

In a cylinder of a two-cycle engine that uses a lubricating oil blended gasoline, cinders such as carbon will adhere to the inner surface of a combustion chamber of the cylinder to become an accumulation while the engine is being used. It is therefore indispensable to clean the combustion chamber by removing the accumulation of the cinders from the inner surface of the combustion chamber from the viewpoint of maintaining the performance of the engine.

However, conventional two-cycle engine cylinders have taken no measures to remove the accumulation easily from the inner surface of the combustion chamber, particularly from the top inner surface thereof. For this reason, removal of the accumulation requires much time and skilled technique, and there is a possibility that the top inner surface of the combustion chamber will be damaged when the accumulation is removed.

SUMMARY OF THE INVENTION

To solve the above problem, an object of the present invention is to provide a two-cycle internal combustion gasoline engine cylinder which is improved to reduce the maintenance expense and assure a high practicability by forming a smooth hard chromium plated layer on a top inner surface of a combustion chamber to reduce the amount of accumulation of carbon on the inner surface of the combustion chamber and by facilitating removal of the accumulation of carbon easily from the inner surface of the combustion chamber without damaging the inner surface of the combustion chamber using a tool such as a screw-driver.

More specifically, the two-cycle engine cylinder according to the present invention is featured in that a smooth hard chromium plated layer is formed on the top inner surface of the combustion chamber of the cylinder.

PREFERRED EMBODIMENTS OF THE INVENTION

Figure 1:
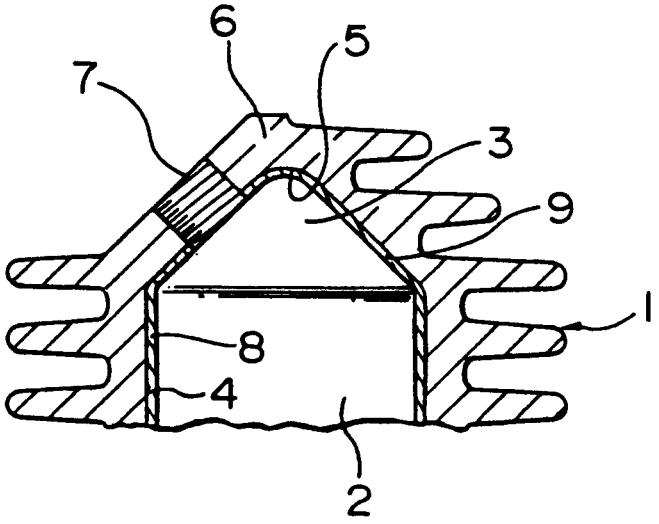
FIG. 1 is a fragmentary sectional view of a two-cycle internal combustion gasoline engine cylinder according to an embodiment of the present invention, showing essential portions thereof in the vicinity of a combustion chamber.

Description will now be given of the present invention with reference to the drawing.

FIG. 1 is a fragmentary sectional view of a small air-cooled two-cycle internal combustion gasoline engine cylinder according to an embodiment of the present invention, showing essential portions thereof in the vicinity of a combustion chamber, the small air-cooled two cycle engine being suitable for use in a grass-trimmer or the like. A cylinder 1 having external cooling fins as shown is made of a light alloy such as an aluminum alloy and is formed therein with a cylinder chamber 2 in which a piston (not shown) is to be received and a combustion chamber 3 connected with the upper part of the cylinder 2. The cylinder chamber 2 has a cylindrical sliding surface 4 with which the piston is made to come into sliding contact, and the combustion chamber 3 has a combustion chamber top inner surface 5 formed in a substantially conical shape. Further, an attaching hole 7 for an ignition plug (not shown) is formed in a top wall 6 of the cylinder 1 which opens into the combustion chamber top inner surface 5. In manufacturing the cylinder 1, hard chromium plated layers 8 and 9 each having a smooth surface are formed simultaneously on the sliding surface 4 of the cylinder chamber 2 and the combustion chamber top inner surface 5 of the combustion chamber 3, respectively, with assuring the hardness of the order of Hv 800 to 1000, for example. In this way, the sliding surface 4 of the cylinder 1 is enabled to make the piston slide smoothly due to the hard chromium plated layer 8 finished with prescribed dimensions by means of the honing, while the surface of the combustion chamber top inner surface 5 is enabled to reduce the amount of accumulations of deposits such as carbon due to the smooth hard chromium plated layer 9 and, further, the accumulation of deposited carbon on that layer 9 can be removed easily without damaging the surface of the combustion chamber 3 by a tool such as a screw-driver.

The hard chromium plated layers 8 and 9 described above can be formed simultaneously using a suitable plating apparatus of the prior art. Further, by forming the plated layer of the cylinder chamber 2 utilizing a method proposed by the present applicant and disclosed in Japanese Patent Application No. 2-143856 so as to have a double-layer structure consisting of a first plated layer the hardness of which is relatively high and a second plated layer the hardness of which is relatively low, it is possible to facilitate the succeeding honing process.

What is claimed is:

1. A two-cycle internal combustion gasoline engine cylinder, in which a smooth hard chromium plated layer is formed on a combustion chamber top inner surface of a cylinder; wherein said layer is formed simultaneously with a smooth hard chromium plated layer on a sliding surface of a cylinder chamber of said cylinder.

2. A two-cycle engine cylinder according to claim 1, wherein the hardness of said smooth hard chromium plated layers is of the order of Hv 800 to 1,000.

3. A two-cycle engine cylinder according to claim 1, wherein said cylinder comprises means for air-cooling comprising external cooling fins formed of a light-weight aluminum alloy.

• • • • •